US005426457A

United States Patent [19]

Raskin

[11] Patent Number: 5,426,457

[45] Date of Patent: Jun. 20, 1995

[54] DIRECTION-INDEPENDENT ENCODER READING; POSITION LEADING AND DELAY, AND UNCERTAINTY TO IMPROVE BIDIRECTIONAL PRINTING

[75] Inventor: Gregory D. Raskin, San Diego, Calif.

[73] Assignee: Hewlett-Packard Company, Palo Alto, Calif.

[21] Appl. No.: 55,660

[22] Filed: Apr. 30, 1993

[51] Int. Cl.[6] ..... B41J 23/00

[52] U.S. Cl. ..... 347/37; 347/14; 400/279; 400/323

[58] Field of Search ..... 346/134, 1.1, 75, 140 R; 400/279, 323; 341/7, 13; 347/9, 14, 37, 39

[56] References Cited

U.S. PATENT DOCUMENTS

| | | | |
|---|---|---|---|
| 4,167,014 | 9/1979 | Darling et al. | 346/75 |
| 4,222,060 | 9/1980 | Sato et al. | 346/140 R |
| 4,524,364 | 6/1985 | Bain et al. | 346/1.1 |
| 4,617,580 | 10/1986 | Miyakawa | 346/140 R |
| 4,789,874 | 12/1988 | Majette et al. | 346/140 R |

FOREIGN PATENT DOCUMENTS

| | | | |
|---|---|---|---|
| 0500116 | 8/1992 | European Pat. Off. | 400/323 |
| 2-310077 | 12/1990 | Japan | 400/323 |

OTHER PUBLICATIONS

IBM; Tracking Carrier Position for Printing in Bidirectional Printers; IBM Technical Disclosure Bulletin, vol. 31, No. 9; Feb. 1989; 265–267.

*Primary Examiner*—Benjamin R. Fuller
*Assistant Examiner*—John E. Barlow, Jr.

[57] ABSTRACT

Inversion of the encoder signal—during pen-carriage operation in just one of two printing directions—advantageously causes development of the position-signal pulse at each encoder bar to be generated from the same edge of each bar, even though the pulse-using circuit is always triggered from the same apparent waveform feature (e. g., a so-called "falling edge"). As a result, the position at which ink is fired from a pen on the carriage is independent of tolerances in bar width. Further asymmetry of timing, provided by addressing each position based on an earlier-arriving encoder-signal pulse and passing that pulse through a delay line, is preferably used to compensate for the fact that ink-drop time-of-flight acts in opposite senses, during pen scanning in the two different printing directions respectively. This time-of-flight effect, for the bidirectionally flying ink drops, produces undesirable offset of the actually printed ink position in opposite directions from the nominal ink-firing point. The invention uses asymmetrical timing in such a way that the ink-firing points, in the two directions respectively, bracket each common, desired mark location; the bidirectionally flying drops then "lead" or approach each common mark location from opposite directions and can be aligned precisely. Another technique is useful when the printer uses large amounts of ink—relative to the amount of liquid carrier that can be absorbed by or evaporated from the printing medium—as for example, when a printer does double-ink-drop printing on transparency stock. In this case print quality can be improved by deliberately selecting a relatively large amount of jitter or random variation in firing time within each pixel column. A preferred amount corresponds to about one eighth of a column width.

16 Claims, 8 Drawing Sheets

DIRECTION-INDEPENDENT ENCODER READING; POSITION LEADING AND DELAY, AND UNCERTAINTY TO IMPROVE BIDIRECTIONAL PRINTING

RELATED PATENT DOCUMENTS

Coowned U.S. Pat. No. 4,789,874 of Majette et al., issued Dec. 6, 1988, sets forth a representative interpolation (or, as it is sometimes designated, "extrapolation") system that is particularly useful in the practice of certain aspects of the present invention. That patent is hereby incorporated by reference in its entirety into this document.

BACKGROUND

1. Field of the Invention

This invention relates generally to machines and procedures for printing text or graphics on printing media such as paper, transparency stock, or other glossy media; and more particularly to such a machine and method that constructs text or images from individual marks created on the printing medium, in a two-dimensional pixel array, by a pen or other marking element or head that scans across the medium bidirectionally.

The invention is particularly beneficial in printers that operate by the thermal-inkjet process—which discharges individual ink drops onto the printing medium. As will be seen, however, certain features of the invention are applicable to other scanning-head printing processes as well.

2. PRIOR ART

Bidirectional operation of any scanning-head device is advantageous in that no time is wasted in slewing or returning the print head across the medium to a starting position after each scan; however, bidirectional operation does present some obstacles to precise positioning of the printed marks, and also to best image quality. In order to describe these obstacles it will be helpful first to set forth some of the context in which these systems operate.

In many printing devices, position information is derived by automatic reading of graduations along a scale or so-called "encoder strip" (or sometimes "code-strip") that is extended across the medium. The graduations typically are in the form of opaque lines marked on a transparent plastic or glass strip, or in the form of solid opaque bars separated by apertures formed through a metal strip.

Such graduations typically are sensed electrooptically to generate an electrical waveform that may be characterized as a square wave, or more rigorously a trapezoidal wave. Electronic circuitry responds to each pulse in the wavetrain, signalling the pen-drive (or other marking-head-drive) mechanism at each pixel location—that is, each point where ink can be discharged to form a properly located picture element as part of the desired image.

These data are compared, or combined, with information about the desired image—triggering the pen or other marking head to produce a mark on the printing medium at each pixel location where a mark is desired. As will be understood, these operations are readily carried out for each of several different ink colors, for printing machines that are capable of printing in different colors.

In addition to this use of the encoder-derived signal as an absolute physical reference for firing the pens, the frequency of the wavetrain is ordinarily used to control the velocity of the pen carriage. Some systems also make other uses of the encoder signal—such as, for example, controlling carriage reversal, acceleration, mark quality, etc. in the end zones of the carriage travel, beyond the extent of the markable image region.

Now, standardized circuitry for responding to each pulse in the encoder-derived signal is most straightforwardly designed to recognize a common feature of each pulse. Thus some circuits may operate from a leading (rising) edge of a pulse, others from a trailing (falling) edge—but generally each circuit will respond only to one or the other, not both.

Such circuits have been developed to a highly refined stage, for use in printers that scan only unidirectionally. Accordingly it is cost-effective and otherwise desirable to employ one of these well-refined, already existing circuits in a machine that scans bidirectionally as well; however, in adapting such a preexisting design for use in a bidirectional machine, two and sometimes three problems arise.

(a) Encoder dimensional tolerances—FIG. 8 illustrates the situation, under the assumption (but only for definiteness) that the encoder-reading circuitry is triggered from falling edges 14 (in other words 14*a*, 14*b*, . . .) of the initial encoder-derived wavetrain 13. The alternating opaque markings 11 and transparent segments 12 (or solid bars and orifices) of the encoder strip 10 are shown in time alignment with the signals 13, 16 that result from reading of those features by a transmissive optical emitter/detector pair.

FIG. 8 shows that the falling edges 14, 17 do not occur at the same physical locations along the strip 10 during operation in opposite directions. (The drawing represents scanning forward by time values $t_F$ increasing toward the right, in one plot $\mathbf{19}_F$ of signal strength $S_F$ vs. time $t_F$—and scanning backward by time values $t_B$ increasing toward the left in another, lower such plot $\mathbf{19}_B$ of $S_B$ vs. $t_B$.) To put it another way, what constitutes a falling edge is different 14, 17 when the carriage moves in opposite directions.

Thus when the carriage moves from left to right, a falling edge 14 is at the right end of each positive square wave; but when the carriage moves from right to left the falling edge 17 is at the left end. These two positions are separated by the width T of a transparent segment (or orifice) 12 of the encoder strip 10.

It will be understood that, in selecting the point at which a mark should be made, it is possible to make allowance for the nominal width of the transparent segment 12. For example, the firing of a pen could be delayed by a period of time automatically calculated from the nominal width of the transparent segment 12 divided by the carriage velocity. Although both these pieces of information are available during operation of the system, the results of this method would be unsatisfactory because of preferred manufacturing procedures for creation of the encoder strip 10. These procedures arise from economics related to dimensional requirements, as follows.

In making the encoder strip 10, the dimension which is most important to hold to highest precision is the overall periodicity P of the alternating opaque bars 11 and transparent segments 12—i. e., the dimension P that gives rise to a full wavelength of the wavetrain. The two internal dimensions of each mark-and-transparent-segment pair—namely, the length B of the bar 11 and the length T of the transparent segment 12—are much less important, particularly if the encoder strip 10 is made for use in a machine that scans only unidirectionally.

In a unidirectional printing machine, only the distance between falling edges 14 (or rising edges 15) has any importance, provided only that (1) the distance B from each falling edge 14 to its next associated rising edge 15 is great enough to permit the sensing apparatus to recognize the falling edge; and (2) the distance T from each rising edge 15 to its next associated falling edge 14 is great enough to permit the sensing apparatus to reset itself in preparation for sensing the falling edge.

More specifically, the dimensional accuracy of the encoder-strip features, as shown in FIG. 8, are plus-or-minus only one percent for the full periodic pattern width P, but plus-or-minus ten to twenty percent for the opaque bar width B alone. If the bidirectional encoder signals 13, 16 are referred to opposite ends of an opaque area or bar 11, the relative accuracy of the positioning in opposite directions tracks the dimensional accuracy of the opaque area 11, namely plus-or-minus ten to twenty percent of nominal width B of the opaque bar.

It would be entirely possible to manufacture an encoder strip with much finer precision in the internal dimensions B, T just mentioned. An encoder strip so made, however, would be substantially more expensive.

Furthermore, it would be wasteful or at least uneconomic to use such an expensive strip in machines that scan only unidirectionally. On the other hand, it would be undesirably expensive to make and stock two different kinds of strip (one inexpensive one for undirectional machines; and another, more expensive, one for bidirectional machines).

Heretofore, accordingly, economical precise bidirectional printing has been deterred by a troublesome choice between two alternative problems: either bidirectional precision is poor, because of imprecisions in the internal dimensions B, T of the encoder-strip features 11, 12; or undesirable expense is incurred in providing high precision in these features.

(b) Time-of-flight and analogous misalignment effects—A certain amount of time elapses between the issuance of a mark-command pulse to a print head and the mark actually being created on the printing medium. For instance, in an inkier printer, some time elapses between:

the issuance of a fire-command pulse—approximately at an encoder-wavetrain falling edge 14*a* (FIG. 9)—to a pen 31 nozzle and the instant when a resulting ink drop 32 actually reaches the medium 33.

During this time, however, the carriage and pen 31 continue to move across the printing medium 33—and, in the case of an inkjet device, so does the ink drop 32, even after leaving the pen 31. The initial velocity component $\sim v_{cF}$ of the drop 32 along the scanning axis or dimension, when scanning forward, is very closely equal to the carriage velocity $v_{cF}$; this velocity likely decreases (though this is not illustrated) while the drop 32 travels in the orthogonal axis or dimension toward the printing medium 33—but nevertheless, as shown in FIG. 9, some forward movement or displacement $\Delta x_F$ of the ink drop 32 along the scanning axis does occur before the drop 32 reaches the medium 33 to form an ink spot 34.

In a printing machine that scans unidirectionally, this delay is substantially inconsequential, for all the ink drops 32 are offset in this same manner by very nearly the same distance, and in the same direction. In other words, the entire image is offset together along the scanning axis; but this does not matter to the resulting printed image because there are no relative offsets within the image—and therefore no discontinuities, no distortions of image features, etc.

As further shown in FIG. 9, however, during scanning in two opposite directions the respective offsets $\Delta x_F$, $\Delta x_B$ that occur are likewise in opposite directions. The result is that, even if pen firing in opposite directions can be triggered at precisely the same point 14*a*, 18*a* along the encoder strip 10, the total mutual offset $\Delta x_T = \Delta x_F + \Delta x_B$ between two resulting image elements is approximately twice the value $\Delta x_F$ or $\Delta x_B$ of an individual time-of-flight-generated offset.

In consequence, when a swath of marks 34 is produced while the marking device 31 travels in one direction ("forward") F, and then another swath 35 is produced while the device 31 travels in the opposite direction ("backward") B, the features 34, 35 constructed in the two swaths will be mutually misaligned. The errors, in a word, are additive.

Physically speaking, the above-described relationships obtain in any prior-art bidirectional inkjet printer. The prior art, however, appears to provide neither recognition of these relationships nor measures to overcome the resulting misalignments.

These adverse effects are not necessarily limited to inkjet devices. Some slight marking delay within the electronic system (and mechanical system, when present) also occurs in other types of scanning printers—such as, for example, dot-matrix or even thermal-paper devices. In principle such delay perhaps can be reduced to a negligible magnitude in a system that is designed from the outset with bidirectional scanning in mind.

Adaptation of already existing unidirectional systems to bidirectional operation, however, may be uneconomic if relatively large marking delay happens to have been built into the original unidirectional system design at a relatively fundamental level. It will be understood that there may have been little motivation for avoiding such a relatively large delay in a unidirectional system, since such delay is readily and satisfactorily compensated at other points in the overall timing.

Thus time-of-flight and analogous misalignment effects impede the effective use of bidirectional printing for creating high-accuracy images. These effects are substantially independent of the imprecisions discussed in the preceding section.

(c) Image mottling—When inkjet printing systems are refined for high color saturation on transparency printing stock, it has been found desirable to put down two (or even more) drops of ink at each pixel location. This treatment provides high color saturation of primary and secondary colors, resulting in color images that are very appealing—and also expanding the gamut of complex colors that can be printed.

It has been noted, however, that when such systems operate bidirectionally, and when timing of the ink-drop firing is made very precise, the printed transparencies exhibit unacceptable "mottling" in solid color-filled areas—particularly for cyan. This visual effect is quite unpleasant and would decrease the value of the printing system to consumers.

One way to avoid this problem is to provide more effective drying, as for example by operating the printer more slowly to provide more drying time between pen passes over the transparency stock. Slower operation, however, unacceptably decreases overall throughput (e. g., pages per unit time) of the work.

U.S. Pat. No. 4,617,580 of Miyakawa teaches that low liquid absorption of transparency film can be combatted in liquid-ink printing by using a plurality of smaller ink droplets onto what would ordinarily be considered a single-pixel area—with the droplets being systematically shifted slightly from one another by a predetermined distance. U.S. Pat. No. 4,575,730 of Logan attempts to correct nonuniform appearance of large-area inkjet printing, referred to as "corduroy texture of washboard appearance", by overlapping of ink spots randomly. It has not been taught, however, how to apply such techniques both economically and effectively in bidirectional printing, particularly in the context of a preexisting machine architecture.

As can now be seen, important aspects of the technology which is used in the field of the invention are susceptible to useful refinement.

SUMMARY OF THE DISCLOSURE

The present invention introduces such refinement. In its preferred embodiments, the present invention has several aspects or facets. These aspects can be practiced independently, but—as will be seen—for optimum enjoyment of all their advantages it is preferable that they be practiced in combination together.

In preferred embodiments of a first facet or aspect, the invention is a method of printing images on a printing medium by construction from individual marks formed in pixel arrays by a bidirectionally scanning print head that operates along a scan axis. The print head thus operates while position of the print head is determined by reference to graduations of a scale—each graduation having first and second physical features.

It will be understood that the phrase "first and second physical features" is used only for definiteness to indicate that there are—and to identify—at least two categories or kinds of physical features. This phrase is not intended to suggest that the "first" features precede the "second" features in any sense or in any particular part of the scale; to the contrary, the physical feature which is found earliest at either end of the scale may be either one of the "first" or one of the "second" physical features as preferred for operational-design purposes.

The method includes the step of scanning the head in a first direction; and also the step of, while scanning the head in the first direction, operating a position-determining system that senses graduations of the scale. The position-determining system encounters the first and second physical features of each graduation in a first particular order.

The method also includes the step of, while scanning the head in the first direction, controlling the head by reference to the first physical features, and those features exclusively, to form marks on the printing medium.

The method of the first aspect of the invention also includes the step of then scanning the head in a second direction. This same method further includes the step of, while scanning the head in the second direction, operating the same position-determining system that senses the same graduations, but that encounters the same first and second physical features of each graduation, but in a second particular order that is the reverse of the first order.

Still further the method of the first facet or aspect of the invention also includes the step of, while scanning the head in the second direction, controlling the head by reference to the first physical features, and again to those features exclusively, to form marks on the printing medium.

By virtue of these provisions, the marks are formed on the printing medium by reference to the same physical positions independent of scanning direction, notwithstanding the reverse order in which the first and second physical features of each graduation are encountered.

The foregoing may be a description or definition of the first aspect of the present invention in its broadest or most general terms. Even in such general or broad forms, however, as can now be seen the invention resolves previously outlined problems of the prior art.

Specifically, since positioning of marks on the medium is always referenced to the same set of physical features, the invention imparts to the pen-positioning system the plus-or-minus-one-percent positioning precision of the full waveform, rather than the plus-or-minus-twenty-percent precision of the opaque sections.

Although the invention thus provides a very significant advance relative to the prior art, nevertheless for greatest enjoyment of the benefits of the invention it is preferably practiced in conjunction with certain other features or characteristics which enhance its benefits.

In particular, preferably the first and second physical features are periodically repeating features, and the method steps operate with respect to those periodically repeating features. Also it is preferred that the first and second physical features be, respectively, first and second edges of each graduation of the scale.

Also preferably, during the scanning of the head in the first direction, the position-determining-system-operating step includes providing a first original position-indicating electrical waveform. This waveform has first and second electrical features of opposite sense, which are derived respectively from sensing of the first and second physical features of the scale.

In this case, during the scanning of the head in the first direction, the head-controlling step comprises controlling the head by reference to the first electrical feature of the first original waveform. Further it is preferable that during scanning of the head in the second direction, the position-determining-system-operating step includes providing a second original position-indicating electrical waveform that has said same first and second electrical waveform that has the same first and second electrical features of opposite sense.

These features are derived respectively from sensing of the first and second physical features of the scale. They are all, however, reversed in sense relative to their occurrences in the first original waveform.

The method in this preferred case also includes the step of, while scanning the head in the second direction and operating the position-determining system, deriving from the second original position-indicating electrical waveform a new version of the second original waveform that has the same first and second features of opposite sense. Now, however, each of these features is reversed in sense relative to those features in the second original waveform; in consequence, the second feature of the new version has the same sense as the first feature of the first original waveform.

As an example of the preferred system just described, the waveform may be a square wave, and the features may be a rising edge and a falling edge of each square pulse; this example is in fact a preferred waveform for use in the invention, but other features may be substituted—as for example a step of particular magnitude, or a voltage spike of particular polarity or magnitude, or in an FM system a frequency shift, etc.

It will be understood with respect to this preferred system that, when the second waveform is properly generated, the second feature of that waveform corresponds physically to the same occurrence as the first feature of the first waveform; that is to say, they represent identically the same position across the printing medium. It will further be understood that the second feature of the new version of the second waveform—which feature now has the same sense as the first feature of the first original waveform—also represents identically the same position across the printing medium as the first feature of the first original waveform.

Thus, continuing the example mentioned above, the print head may be controlled by reference to a falling edge during operation in both directions. A preexisting, well-refined and now standard electronic system, moreover, is able—by virtue of the reversal of sense—to respond identically to (1) the second feature of the new version and (2) the first feature of the first original waveform.

In short, the apparatus can define each pen position by reference to an identically same feature (merely twice reversed in sense) of the basic waveform; and so by reference to a physically identical position across the printing medium. Hence the above-stated precisional improvement is obtained with an electronic system that is only minimally modified—i. e., merely by insertion of a sense-reversing stage that acts during scanning in one direction only.

It will be understood, however, that basically these same benefits precisional benefits may be obtained with a somewhat greater degree of systemic redesign by causing the position-determining system to—for instance—respond to rising edges during scanning exclusively in one direction, but to trigger from falling edges during scanning in the opposite direction.

As another example of additional characteristics or features that further enhance the benefits of the invention, it is preferred that the deriving step include inverting the second original waveform to generate an inverted waveform that is the new version. Inversion is simply the appropriate transformation required to reverse the sense of the features in the preferred case of a square wave, in which the features as mentioned earlier are a rising edge and a falling edge—and could also be appropriate in the case of a spike of particular polarity; but more elaborate measures might be required in, e. g., an FM system.

It is also preferred that the print head include an inkjet pen; and that the controlling step include operating the inkjet pen to propel ink drops toward the printing medium to form the marks on the medium. In addition, as mentioned previously it is preferable to practice this first facet or aspect of the invention in conjunction with other aspects that are set forth below.

In preferred embodiments of a second, related facet, the invention is apparatus for printing images on a printing medium by construction from individual marks formed in pixel arrays. The apparatus includes some means for supporting such a printing medium; for purposes of generality and breadth in discussion of the invention, these means will be called the "supporting means". (In the preceding sentence, and in certain of the appended claims, the word "such" is used to emphasize that the printing medium is not necessarily itself a part of the apparatus of the invention, but rather only a part of the operating context or environment of the invention.)

The apparatus also includes a print head mounted for motion across the medium, and some means for scanning the head bidirectionally across the medium—which means (again for breadth and generality) will be called the "scanning means". In addition the apparatus has a encoder strip extended across the supporting means, parallel to the print-head motion across the medium.

Further included in the apparatus are some electrooptical means for reading the encoder strip to generate a square wave whose pulses correspond to positions across the medium, respectively. Also included are some means, connected to receive the square wave from the "electrooptical means", for responding to the first physical features exclusively—irrespective of scanning direction—to control the head to form marks on the medium; these last-mentioned means will be called the "responding means".

The preceding paragraphs may provide a definition or description of preferred embodiments of the second facet or aspect of the invention in its most general, broad form. Even in this general form, however, this facet of the invention can be seen to provide needed refinement of the prior art.

In particular the invention in this form makes possible pen positioning that is referred to actual physical features of a mechanical structure (the encoder strip)—and specifically to the identically same features during pen scanning in both directions. In the special case of a bidirectional pair of position determinations both referred to a single identical feature, the imprecision associated with relative positional measurement as between the two positions might be reduced substantially to the limiting value controlled by the process of sensing the encoder-strip features, as distinguished from values established by mechanical tolerances of the encoder strip.

(As will be explained below, this is not the most highly preferred form of the invention. It could, however, be useful for special applications such as, for example, forming an extremely precise registration or alignment mark—consisting of two very closely spaced dots or lines.)

Although this second facet of the invention in its broad form is thus beneficial, for greatest enjoyment of its benefits the second facet of the invention is preferably practiced in conjunction with certain other features or characteristics. Some of these are the previously mentioned other independent facets or aspects of the invention.

In particular, as will shortly be explained in relation to the third and fourth facets of the invention, it is highly preferable to refer position-determination pairs for a single desired mark to two correspondingly adjacent pairs of transparent (or opaque) elements of the encoder strip, rather than to a single element. In this considerably more advantageous case—the case of specific image details that are referred to any two different encoder-strip features, during pen scanning in two different directions—positioning can be accomplished within the dimensional tolerance that is associated with a full period of the encoder strip's periodic structure.

This dimensional tolerance most typically is greater than the sensing-process imprecision mentioned in the fourth preceding paragraph. It is preferably, however, at least an entire order of magnitude finer than the imprecision associated with the width of an individual transparent (or opaque) element of the strip. The word "preferably" is used here because—as mentioned in the "PRIOR ART" section of this document—significant economy is realized by fabricating an encoder strip in which the individual elements have much looser tolerance than that of a full periodic structure.

Thus it is preferable that the encoder strip have (1) dimensional tolerance on the order of plus-or-minus one percent from a particular one side of each opaque element to the corresponding particular one side of the next opaque element; and (2) dimensional tolerance on the order of plus-or-minus ten to twenty percent across each opaque element. Correspondingly it is preferred that, through operation of the direction-sensitive means mentioned above, the positioning precision of the responding means be on the order of plus-or-minus one percent.

It is also considered preferable that the above-introduced "responding means" include some means for responding to falling edges of a received wavetrain to control the head to form marks on the medium. (For purposes of this second aspect of the invention it will be understood that other waveform types, and corresponding other features—as mentioned above—may be equivalents of a square wave and its falling edges.)

The apparatus of this preferred form of the second facet of the invention additionally has direction-sensitive means, connected between the electrooptical means and the responding means, for inverting the square wave before receipt by the responding means during scanning in only one of two directions of scanning of the head across the medium. (Here too, as discussed earlier with regard to FM systems and the like, other kinds of sense reversal may be equivalent to inversion, for other types of waveforms.)

A third aspect of the invention, in preferred embodiments, is a method of printing images on a printing medium by construction from individual marks formed in pixel arrays by a bidirectionally scanning print head. This method includes the step of scanning the head in a first direction.

The method also includes the step of, while scanning the head in the first direction, at a first triggering position firstly initiating formation of a first mark on the printing medium. This first mark is formed on the medium at a first mark location that is (because of time-of-flight or analogous effects discussed earlier) further along the first direction than the first triggering position.

The method additionally includes the steps of then scanning the head in a second direction; and while scanning the head in the second direction, at a second triggering position secondly initiating formation of a second mark on the printing medium. (As will be understood, most typically the scanning of the head in the first direction is completed by reaching an opposite edge of the printing medium from a starting edge, before scanning in the second direction begins; and most typically the two directions are simply opposite directions along a single pen-scanning axis.)

This second mark then is formed on the medium at a second mark location that is further along the second direction than the second triggering position. In accordance with this method, the second triggering position is further along the first direction than the first mark location.

This third aspect of the invention, even as thus broadly or generally expressed, can now be seen to provide a very important benefit relative to prior systems discussed earlier—namely, that the undesirable, oppositely acting time-of-flight effects can be overcome by this method of approaching the desired mark position from two correspondingly opposite trigger points. In other words, the desired mark position is bracketed between two trigger points: one is used when the pen approaches from the first direction, and the other when the pen approaches from the second direction.

While this method, as broadly characterized, thereby provides an important refinement, yet for full enjoyment of its benefits it is preferably practiced in conjunction with certain other characteristics or features. In particular it is preferred that the first and second triggering positions be, at least roughly, equidistant from the first mark so that the first and second marks are at least roughly aligned with each other.

It is also preferred—if the invention is practiced in a preferred context of a printing system which provides a system of fine, subpixel spacings through for example interpolation between encoder features—that at least one of the first and second triggering positions be automatically positioned to within approximately the nearest twenty-fourth of a millimeter (six-hundredth of an inch) of a location required to bring the first and second marks into mutual alignment.

In other systems that are instead referred directly to encoder structures or other periodic structures along a scale, preferably the "firstly initiating" step includes the substep of, while scanning the head in the first direction, firstly counting periodic structures along a scale to locate a first particular one of those structures. This first particular one structure will be used to define a position for triggering formation of a first mark on the printing medium. In this case preferably the "firstly initiating" step also includes the substep of triggering formation of the first mark with reference to the first particular one structure.

In addition, still in regard to systems in which positioning is directly referred to encoder structures, the "secondly initiating" step preferably includes the substep of, while scanning the head in the second direction, secondly counting periodic structures along the same scale to locate a second particular one of said structures. This second particular one structure will be used to define a position with reference to which formation of a second mark on the medium—in alignment with the first mark—is to be triggered. The "secondly initiating" step of this preferred form of the invention (for direct-encoder-reference systems) also includes the substep of triggering formation of the second mark with reference to the second particular one structure.

Moreover, the "secondly-counting" step mentioned above includes:

(a) counting to a periodic structure that is displaced along the scale by at least one structural unit from the first particular one of said structures, and (b) identifying said displaced periodic structure as said second particular one of the periodic structures.

In summary, to make two marks that are mutually aligned, during scanning in two different directions respectively, the system does not trigger the two mark formations from one single structural element or unit of the scale. Rather it triggers the two mark formations from two different triggering or initiation points, respectively, which in direct-encoder-reference systems are mutually displaced by at least one structural unit.

This preferred method for direct-encoder-reference systems also includes the step of, after counting to the second particular one of the structures, delaying the triggering of formation of the second mark so that the second mark, taking into account time that elapses in formation of both marks, is substantially aligned with the first mark.

In addition it is preferred, now again with reference more generally to the third aspect or facet of the invention, that the print head include an inkier pen; and that the triggering step include directing an electrical signal to the inkjet pen to propel ink drops toward the printing medium to form the marks on the medium. As will now be seen, this third aspect of the invention has particular advantageousness when the print head is an inkjet pen, because of the virtually unavoidable, fundamental nature of ink-drop time-of-flight effects in the use of bidirectionally scanning inkjet pens; however, analogous marking delays in other systems (mentioned in the "PRIOR ART" section) render this aspect of the invention useful even in systems that do not employ propelled ink drops.

In direct-encoder reference systems it is also preferred that the secondly-counting step include counting to a periodic structure that is displaced along the scale by exactly one structural unit from the first particular one structure. In addition it is preferred that the delaying step include delaying the triggering until the marking head reaches a triggering point that is a particular fraction of the length of one structural unit past the second particular one structure.

In this connection it is further preferred that the first mark be formed toward the first direction from the first particular one structure, by a first specific fraction of one structural unit; and that the second mark be formed toward the second direction from the triggering point, by a second specific fraction of one structural unit. With these provisions in place, then it is also preferred that the particular fraction, plus the first and second specific fractions just mentioned, equal unity.

In physical terms—for an inkjet system—what this means is that the distance between two adjacent periodic features (e. g., left-hand edges of graduations) of the scale is in effect divided, or allocated, into three segments:

(1) the flight distance for an ink drop travelling in the first direction, plus any other mechanical delays or triggering delays inherently in the system;

(2) the flight distance for an ink drop travelling in the second direction, plus other mechanical or inherent triggering delays; and (3) the distance travelled by the pen during a deliberately introduced additional triggering delay that is selected to make the two drops land at substantially the same point.

An analogous division is employed, even when there is no ink-drop "flight distance" or "time of flight", to accommodate the mechanical delays and inherent triggering delays alone.

A fourth facet or aspect of the invention, in its preferred embodiments, is apparatus for printing images on a printing medium by construction from individual marks formed in pixel arrays. This apparatus includes some means for supporting such a printing medium—which as before will be called the "supporting means".

The apparatus also includes a print head supported for motion across the medium, when the medium is mounted in the medium-supporting means. In addition the apparatus includes some means for scanning the head bidirectionally across the medium.

Also the apparatus includes an encoder strip extended across the medium, parallel to the print-head motion across the medium. Further included in the apparatus are some electrooptical means for reading the encoder strip to generate electronic pulses that correspond respectively to positions along the encoder strip, and thereby to positions across the medium.

Additionally the apparatus includes some means, connected to receive the pulses from the electrooptical means, for counting and responding to the pulses to control the head to form marks on the medium at particular locations. The apparatus also includes some direction-sensitive means, connected between the electrooptical means and the responding means, for—in effect—counting at least one pulse less (in other words, in effect counting to a position that is corresponds to a pulse count that is smaller by at least one) during scanning to particular locations, but in only one of two directions of scanning of the head across the medium.

As can now be appreciated, this fourth, apparatus aspect or facet of the invention is related to the second, method aspect already introduced—and, even in the general form just described, has closely related advantages. In particular, the already-described beneficial tripartite allocation of portions of the spacing between periodic features of a scale is here applied in the context of the special kind of scale known as an encoder strip.

Nevertheless, as before it is preferred to practice this fourth aspect of the invention in conjunction with additional characteristics or features that enhance and optimize the benefits of the invention. For example it is preferred that the direction-sensitive means further include means for interposing a delay between the electrooptical means and the responding means, during scanning in only one direction—whereby control of the head to form marks on the medium is delayed after occurrences of particular pulse counts.

Although in principle this extra delay can be interposed during scanning in either of the two directions, as a practical matter it will generally be found somewhat preferable that the scanning direction during which the direction-sensitive means interpose the delay be the same direction as that in which the pulse count is decremented—namely, the second direction. By means of this arrangement, the interposing means delay control of the head to form marks on the medium, after occurrences of the one-pulse-decremented pulse counts.

The reason for this preference arises from the special advantageousness of adding these bidirectional-operation features into a preexisting unidirectional-apparatus design. In this context it is preferable, for economy of engineering and product maintenance, that the additional hardware and firmware be added by way of modules that are as self-contained, and as small in number, as possible. Thus a module that both decrements the count and interposes a delay—and that is switched into operation to do both these functions during scanning in one direction only—may be somewhat simpler to implement than one that affects operation in both directions.

(For purposes of this fourth facet of the invention, as will be understood the use of an earlier-occurring pulse from an interpolation stage is a substantial equivalent of decrementing the encoder pulse count and then interposing a delay.)

Preferably the delay-interposing means include a delay line that is switched into the connection between the electrooptical means and the responding means, only during scanning in one direction. Preferably the delay line includes a shift register that is advanced by a signal from a sample clock.

A fifth aspect or facet of the invention, in preferred embodiments, is a method of printing images on a printing medium by construction from individual marks formed in pixel arrays by a bidirectionally scanning inkjet pen, This method includes the step of scanning the pen in a first direction across such a medium.

The method also includes the step of—while scanning the pen in the first direction—monitoring the position of the pen relative to desired pixel locations, and firing the pen to form an ink spot of particular color on the medium in each particular desired ink-spot pixel location. The method also includes the step of then scanning the pen in a second direction across such medium.

In addition the method includes the step of, while scanning the pen in the second direction, monitoring the position of the pen relative to desired pixel locations, and firing the pen to form an ink spot of the same particular color on the medium in each same particular desired ink-spot pixel location. The result of this step, in conjunction with the previous steps, is that at least two spots of ink of that particular color are formed at each desired ink-spot pixel location.

In this method, the monitoring portion of each monitoring-and-firing step has an associated positional uncertainty. As a consequence, (1) the firing portion of each monitoring-and-firing step and (2) each resulting ink-spot pixel location are both subject to at least that amount of positional uncertainty.

This method has an additional step, namely selecting a relatively high value of the positional uncertainty. It will be noted that deliberately choosing a relatively high value in this way is antithetical to ordinary system-optimization criteria, in that usually a basic objective is to make precision as fine as possible—which is to say, to make positional uncertainty as small as possible.

Nevertheless it has been discovered that under certain special circumstances this method, which has now been described in its broadest or most general form, has special benefits. It is preferred that this method be used in such special circumstances only, since as already noted the method has an associated imprecision which, more ordinarily, is undesirable.

Such special circumstances are, in particular, that (1) the printing medium is transparency stock; and (2) the firing portion of each monitoring-and-firing step comprises directing an electrical signal to an inkjet pen to propel an ink drop toward the transparency stock to form the ink spot on that stock. Under these circumstances, as mentioned in the "PRIOR ART" section of this document, excessive amounts of liquid carrier (for the ink dye) tend to be deposited on the transparency stock—and these amounts of liquid tend to puddle in such a way as to create an esthetically undesirable mottled appearance.

The method of this fifth aspect or facet of the invention has the beneficial effect of reducing this mottling; and it has been found particularly useful, for certain printing apparatus, in the printing of cyan. The exact mechanism of this mottling reduction is not well established, but it is thought that the slight misalignment between ink spots reduces the overall average amount of ink placed on small areas of the transparency stock per unit time (sometimes called "ink-flux effects"), and hence the mottling.

As with the facets of the invention discussed previously, the one now under discussion is preferably practiced with certain additional features or characteristics that enhance and optimize the benefits. For example, it is preferred that the relatively high value correspond to significantly more than one sixteenth of one pixel column width. It is even more highly preferable to make the relatively high value correspond to approximately one eighth of one pixel column width.

It is particularly preferred that the monitoring portion of each monitoring-and-firing step include the substep of responding to pulses from an electrooptical sensor that detects periodic structures of an encoder strip extended across the medium; and that the firing portion of each monitoring-and-firing step include the substep of responding to a clock, which runs asynchronously with the the sensor pulses, to develop electrical signals for triggering discharge of ink drops from the pen.

In this context, the associated positional uncertainty arises from the period of the asynchronous clock; and the setting step comprises setting the period of the asynchronous clock. Use of a clock that is asynchronous relative to the pulses from the encoder strip is thought to be particularly beneficial as it renders the positioning of each ink spot on the medium truly uncertain—that is to say, actually varying, within the limit of uncertainty established by the clock period—so as to provide the interdrop misalignments mentioned above.

Furthermore, the asynchronicity provides at least a good approximation to randomness of this variation. The random nature of the misalignments causes the variation to "average out" in such a way that it is not apparent to the observer, or at least to the casual observer. Preferably the positioning uncertainty produced by operation of the asynchronous clock is equal to the period of the asynchronous clock multiplied by the velocity of the pen in the scanning steps.

It is particularly advantageous that at least the asynchronous clock, and preferably means for its setting as well, be substantially available in the electronics for some other purpose. In the present case, at least the first of these conditions is satisfied.

More particularly, the clock-responding substep includes sending an electrical signal through a delay line to trigger discharge of ink drops from the pen; and the delay line is clocked by the sensor-pulse-asynchronous clock. As will be recalled from discussion of the third and fourth facets or aspects of the invention, the delay line is advantageously provided for another purpose in regard to those aspects of the invention.

That purpose is, namely, to offset the ink-discharge triggering point during scanning in one direction, so that ink spots fired during pen motion in the two directions, respectively, will land at substantially common points. Hence to take advantage of this fifth aspect of the invention it is only necessary to feed a suitable period-control signal into the sample-clock input lead for that already-existing delay line.

Preferably the relatively high value exceeds the time interval during which the pen scans through one-sixteenth of a pixel column. Even more preferably, the relatively high value is approximately the time interval during which the pen scans through one eighth of a pixel column.

For the particular apparatus with which the present invention has been tested, it is also preferable that the relatively high value exceed forty microseconds. It is even more highly preferable that the relatively high value be approximately forty-three microseconds.

A sixth aspect or method of the invention, in its preferred embodiments, is apparatus for printing images on a printing medium by construction from individual marks formed in pixel arrays by a bidirectionally scanning inkjet pen. The apparatus includes some means for supporting such a printing medium.

The apparatus also includes a pen mounted for motion across the medium, when the medium is supported in the medium-supporting means. In addition the apparatus includes some means for scanning the pen bidirectionally across the medium.

Further the apparatus includes some means for triggering the pen to discharge ink drops toward such medium to form at least two ink spots in each pixel position where ink is desired. These pen triggering-means include some means for defining a sequence of elementary time intervals, during each of which intervals the pen can be triggered. In addition the apparatus includes some means for adjusting the value of each elementary time interval to a relatively high value.

This apparatus can be used to implement the fifth, method aspect of the invention discussed above, and has, very generally speaking, the same advantages.

It also has generally related, analogous preferred features or characteristics—such as for example, means for interposing a delay in triggering the pen. The delay-interposing means preferably include a clock that runs substantially asynchronously relative to passage of the scanning pen between pixel locations; and the apparatus also preferably includes some means for setting a period of the asynchronously running clock to a relatively high time value, to establish the desired relatively high uncertainty value.

Preferably the delay-interposing means include a delay line that is clocked by the asynchronously running clock, only during scanning of the pen in one direction. Preferably the delay line includes a shift register that is advanced by a signal from the clock.

All of the foregoing operational principles and advantages of the present invention will be more fully appreciated upon consideration of the following detailed description, with reference to the appended drawings, of which:

DETAILED DESCRIPTION OF THE PREFERRED EMBODIMENTS

Preferred methods and apparatus of the invention incorporate all of the several facets or aspects of the invention together. Preferred methods and apparatus incorporate the various preferred features or characteristics as well.

1. ENCODER-SIGNAL INVERSION

Figure 1:
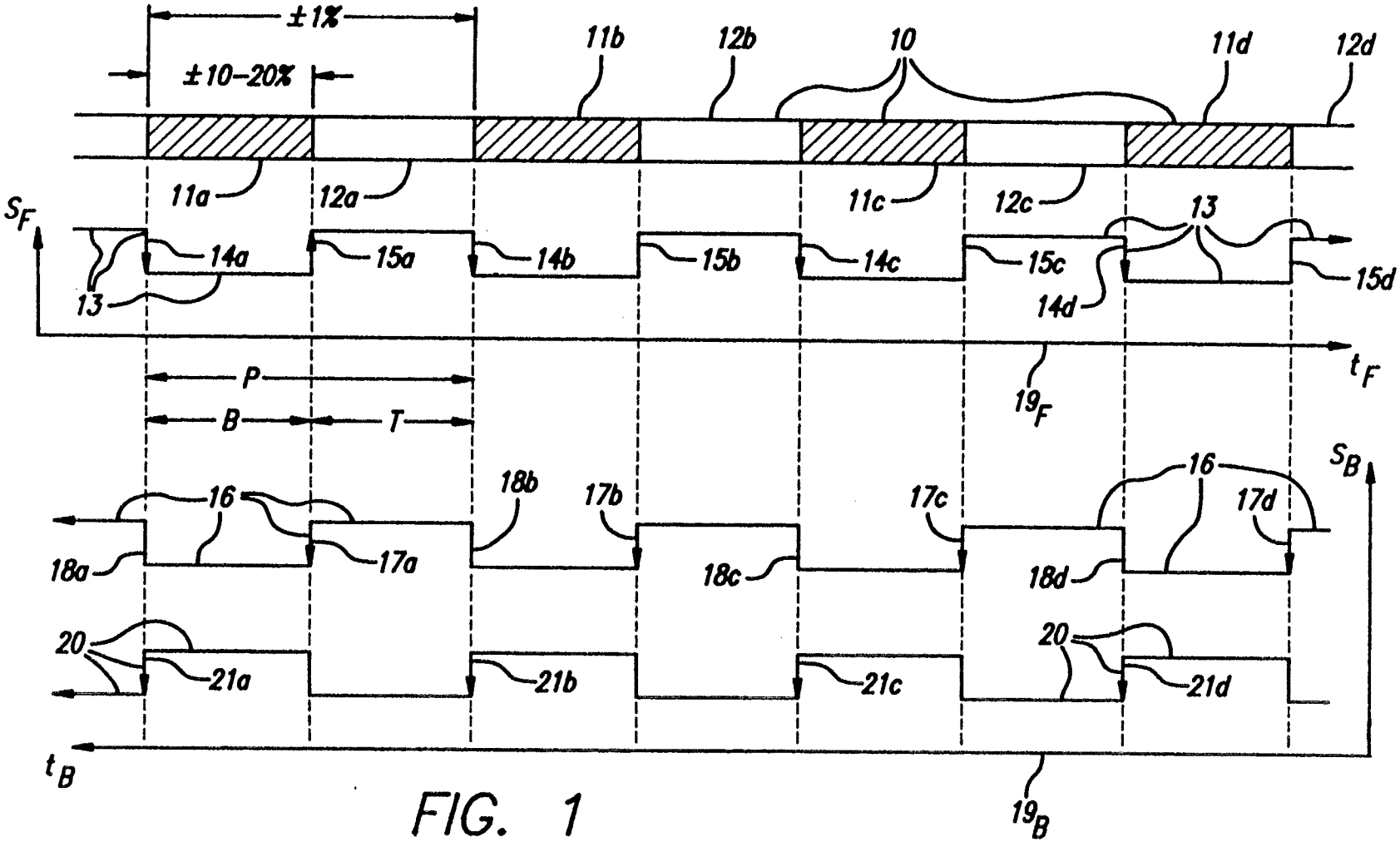
FIG. 1 is a diagram of the precision-enhancing asymmetrical timing relationships produced by the present invention—in particular FIG. 1 illustrating signal inversion, and FIG. 2 pulse decrementation and firing delay.

As FIG. 1 shows, an inverted form 20 of the encoder signal 16 is generated for one direction of carriage motion but not the other—say, for example, inverted for right-to-left motion B only, as exemplified in the drawing by the lower plot of signal strength $S_B$ vs. time $t_B$. This asymmetrical inversion avoids errors due to dimensional tolerances of the opaque areas 11 (or transparent areas 12) of the encoder strip 10. The basic firing reference accuracy of the bidirectional system thus becomes equal to that of a unidirectional system.

When the inverted signal 20 is used in the reverse or backward direction B, the falling edges 14, 21 of the encoder signal 13, 20 are all referred (or, as it is sometimes put, "referenced") to the same physical positions on the encoder strip regardless of carriage direction. Therefore, in special cases that may permit using one physical reference point along the strip as a trigger point for some type of function during scanning in both directions—although this is not a useful operational mode for inkjet-pen printing generally—the only source of positional imprecision will be that arising in the encoder sensing system.

2. DROP LEAD TIME AND FIRING-PULSE DELAY

More generally, as will now be explained, to avoid time-of-flight and related delay problems it is necessary to use two reference positions—for example, falling edges 14*a*, 14*b*—that are adjacent. (Even more generally still, it is possible that in some systems having relatively long ink-drop flight times or relatively very fine encoder structures, or both, it may be necessary or preferred to use two reference positions 14*a*, 14*c* that are further apart—for instance, two or even more encoder structures apart.)

In these more-generally useful cases, relative accuracy of the signals 14*a*, 21*b* used as references for ink discharge at a particular column location (for example, "a" in FIGS. 1 and 2) will track the plus-or-minus one percent dimensional tolerance for the distance P between any two adjacent reference positions (falling edges 14, 21 of the encoder-strip signal 10, 20).

An object of bidirectional printing is to cause drops 32, 32'' (FIG. 2) fired for a particular column position ("a") to reach the paper 33 at substantially the same physical location 34 on the paper during both left-to-right and right-to-left carriage motion F, B. The present invention achieves this objective by using adjacent encoder pulses 14*a*, 21*b*, along with a switchable delay line.

The reason that the same encoder position cannot be used for both directions, as explained in the "PRIOR ART" section, is that the bidirectional drop-impact offsets $\Delta x_F$, $\Delta x_B$ are in opposite directions. Accordingly the drops 32, 32', 32'', 14 cannot be made to land in the same position, if they are fired from any single common discharge point 14.

According to the invention, the machine in effect is made to execute an operation that might be characterized as "backing up" or "backing off" by some distance in order to allow time for the backward-scan drop 32' to fly to the same position 34 as reached during scanning in the opposite direction. This may also be described as allowing the machine to "lead" the drop 32'.

One straightforward approach is to back off by one encoder interval P—which is to say, one full encoder-pulse wavelength, as from the forward-scan falling edge 14*a* used to form an ink spot 34 in a particular pixel location "a" to an adjacent backward-scan falling edge 21*b*. This provision alone would not be sufficient to produce exact alignment of drops 32, 32' fired from two directions; it would be sufficient only if the ink-drop flight distance $\Delta x_F$ happened to be precisely one-half the full encoder-structure spacing T.

Such correlation is not to be expected generally; and in every other case—once the discharge time of the machine has been backed off enough—the two drops 32, 32' would come to rest in two respective positions 34, 35 separated by a residual error or offset $\Delta x_R$. Some additional delay $\Delta t$ must be added back in to bring the two drops to the same landing site 34.

In principle this delay could be added in establishing the firing time in either direction—or even split into two portions for use in both scanning directions, respectively—and with very satisfactory results; but preferably the delay is added into the system while scanning in the same direction as that in which counting is at least one pulse less (that is to say, the same direction as that in which the firing point is backed off by at leat one pulse).

Figure 2:
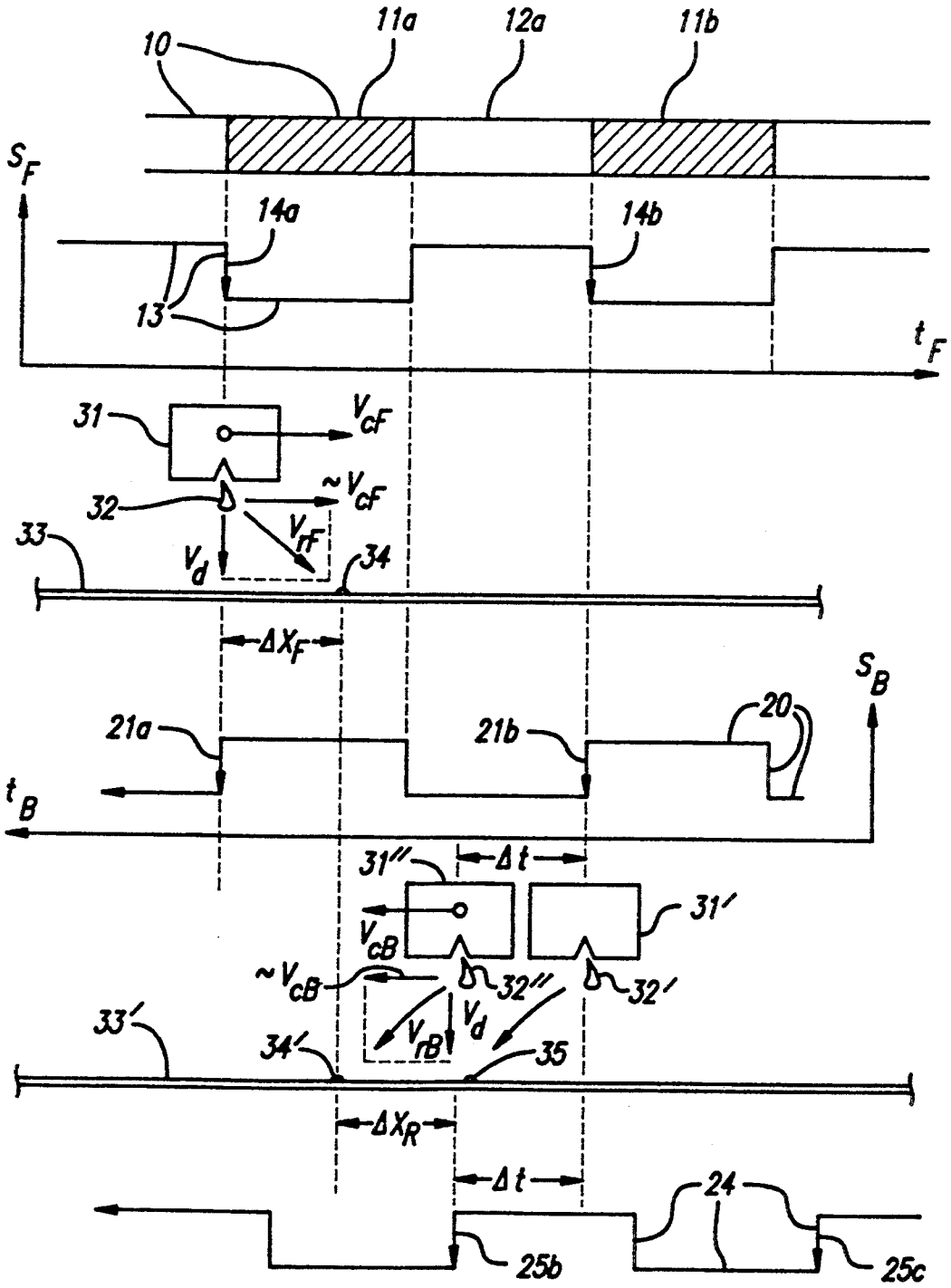

Also in principle each firing pulse individually could be delayed from occurrence of its respective falling edge (e. g., 21*b*), but preferably and more simply the entire inverted waveform 20 is delayed to form a delayed inverted waveform 24 (FIG. 2). As will be understood, these two techniques are substantially equivalent, differing primarily in design or operational convenience.

In summary, the drop-impact offset due to each drop's velocity component along the paper axis requires that adjacent firing reference pulses 14, 21 be used to lead the drop 32' when firing to a particular column position 34 from one of two bidirectional scanning directions F, B.

3. HARDWARE FOR ASYMMETRICAL TIMING

The preceding two sections set forth measures that are advantageously taken to improve positional precision—(1) encoder-signal inversion, and (2) drop lead time and firing-pulse delay. These measures are preferably taken during scanning in one direction only, and for purposes of design economy (particularly in a design-retrofit situation) all during scanning in a common direction.

Figure 4:
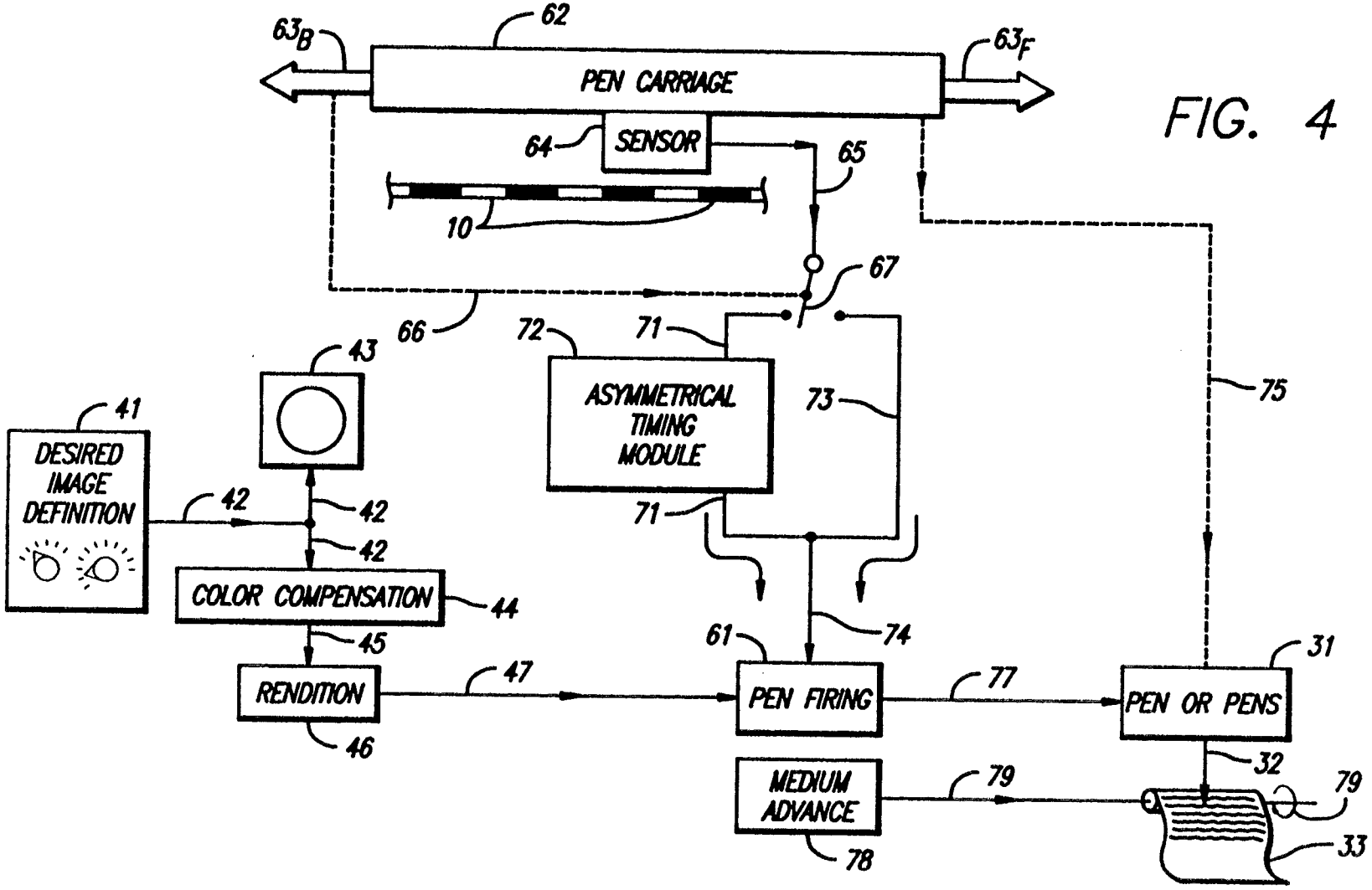
FIG. 4 is an electronic block diagram of a printing system incorporating the asymmetrical-timing module of the present invention.

FIG. 4 illustrates the general preferred layout. An input stage 41, which may include manual controls, provides information defining the desired image. The output 42 of this stage may proceed to a display 43 if desired to facilitate esthetic or other such choices; and, in the case of color printing systems, to a color-compensation stage 44 to correct for known differences between characteristics of the display 43 and/or input source 41 system vs. the printing system 47-61-31-32-33.

An output 45 from the compensator 44 proceeds next to a rendition stage 46 that determines how to implement the desired image at the level of individual pixel-position printing decisions—for each color, if applicable. The resuling output 47 is directed to a circuit 61 that determines when to direct a firing signal 77 to each pen 31.

The pen discharges ink 32 to form images on paper or some other printing medium 33. Meanwhile typically a medium-advance module 78 provides relative movement 79 of the medium 33 in relation to the pen 31.

In developing its firing-signal determination, the firing circuit 61 must take into account the position of the pen carriage 62, pen mount 75 and pen 31. Such accounting is enabled by operation of an electroooptical sensor 64 that rides on the carriage 62 and reads a encoder strip 10.

In the prior art such information typically is conveyed from the sensor 64 to the pen-firing circuit 61 by a substantially direct connection 65-73-74. The present invention contemplates inserting a timing module 72 into the line between the sensor 64 and firing circuit 61.

As will be seen, the timing module 72 provides for encoder-signal inversion or equivalent during scanning in one of two directions. It also provides for backing off by one pulse and then delay in pen firing, also during scanning in one of two directions.

Operation of this timing module 72 thus is not desired at all times, but rather only synchronously with the directional reversals of the carriage 62. Specifically, the timing module 72 is to be inserted during operation in one direction only, and replaced by a straight-through bypass connection 73 during operation in the other direction—in other words, operated asymmetrically—and this is the reason the timing module 72 is labelled in FIG. 4 "asymmetrical".

This synchronous insertion and removal is symbolized in FIG. 4 by a switch 67 which selects between the conventional connection 73 and a timing-module connection 71. This switch 67 is shown as controlled by a signal 66 that is in turn derived from backward motion $63_B$ of the pen carriage 62.

Thus the switch 67 is operated to select the timing-module connection 71 during such backward motion $63_B$, and to select the bypass or conventional route 73 during forward motion $63_F$. This representation is merely symbolic for tutorial purposes; people skilled in the art will understand that the switch 67 may not exist as a discrete physical element, and/or may instead be controlled from the forward motion $_F$ and/or—as will much more commonly be the case—can be controlled by some upstream timing signal which also controls in common the pen-carriage motion $63_B$, $63_F$. Further the synchronous switch 67 need not be at the input side of the timing module 72 but instead at the output side—where in FIG. 4 a common converging signal line 74 is shown as leading to the firing circuit 61—or may in effect be at both sides.

Use of a system as illustrated in FIG. 4, at least as most naturally interpreted, will result in the encoder-signal inversion, the pulse "backing off" step and the firing delay step all being performed during pen motion in the same, common ("backward") direction. As mentioned earlier, however, this limitation while preferred is not required for successful practice of the invention.

4. TIMING MODULES FOR DIRECT-ENCODER-REFERENCE SYSTEMS

Within the FIG. 4 timing module 72, in systems that operate in essence directly from the encoder subsystem a circuit 89 (FIG. 5) may be provided to invert the encoder signal 65 in one direction B of pen-carriage motion; and a delay line 81-85 may be used to delay the encoder signal 65 in one direction B of pen-carriage motion, to adjust the firing-pulse timing and so cause the drop impact position to coincide with that which results from the opposite direction of carriage motion.

Methods of selecting or controlling (or both) the delay value can be manual or automatic, fixed-value or variable.

The delay line 81-85 is made up of a shift register 81, stepped by a sample-clock signal 82. To provide adjustability over an ample range, the register 81 is a 64-bit unit providing a very large dynamic range and adjustment resolution. In fact the resolution is higher than necessary; accordingly only every other flipflop within the shift register 81 is connected out by output lines 81' to a selector device 83, which correspondingly is only a 32-bit device.

To complete the arrangements for adjustability, a delay-select device 84 provides a control signal 85 that addresses one of the thirty-two positions of the selector 83. The selector then supplies an output 86 of the signal from some preferred one of the outputs of the selector 83.

That output 86 proceeds to a multiplexing selector 87, which simply passes through to its output 88 either the delay-line output 86 or the undelayed encoder pulse train 65 along a bypass line 73.

Figure 5:
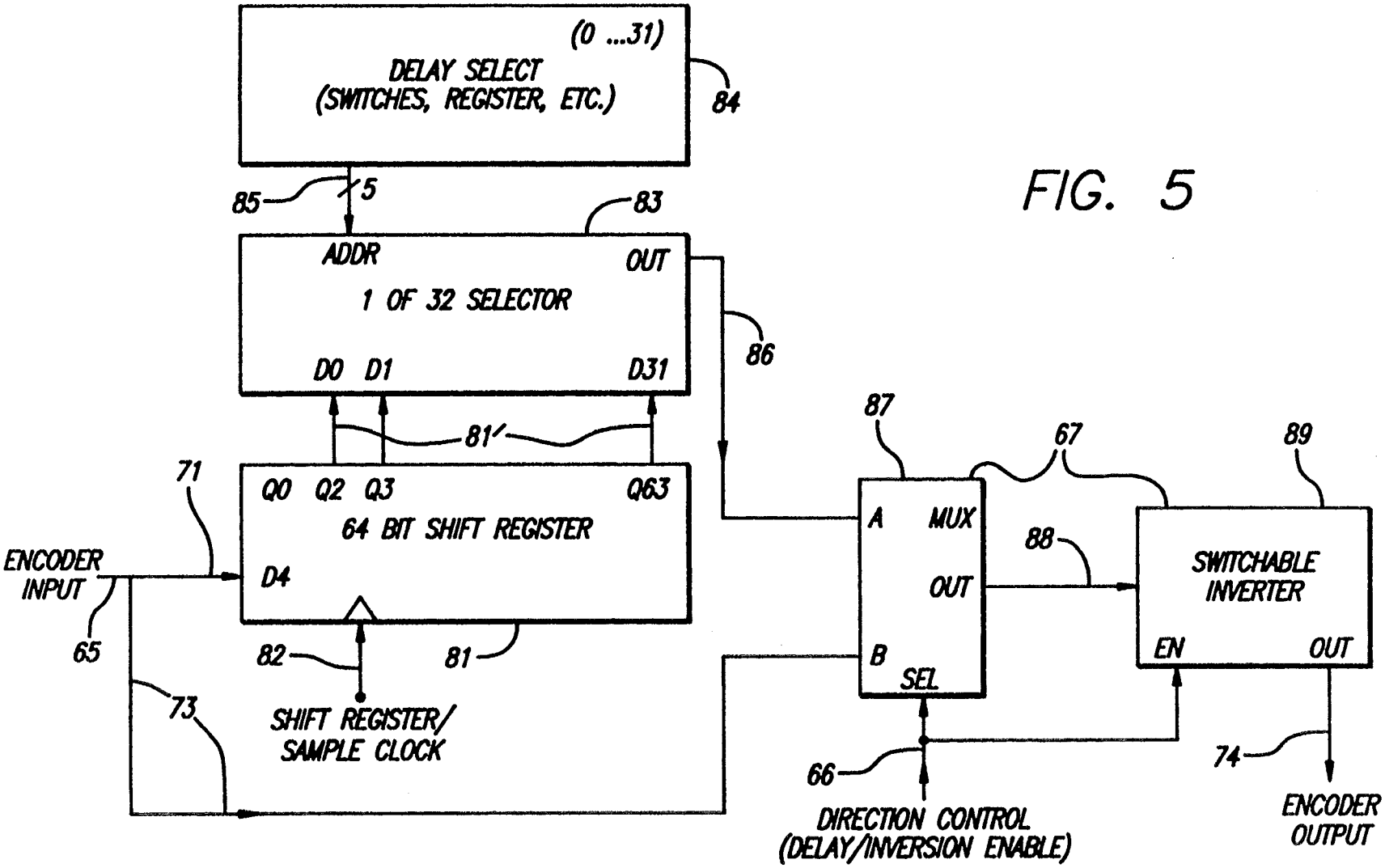
FIG. 5 is an electronic schematic of the asymmetrical-timing module (in an adjustable form) showing the precision-enhancing mechanisms used to produce both the encoder-signal inversion and the time-of-flight-compensating delay, in a direct-encoder-reference system.

In FIG. 5 the functions of the symbolically represented switch 67 of FIG. 4 may be seen as embodied in the multiplexer 87. (In different systems these functions might be regarded as somewhat distributed between the multiplexer 87 and switchable inverter 89.) Also in FIG. 5 the output 88 of the multiplex selector 87 is shown as proceeding to a switchable inverter 89, and both the multiplexer 87 and inverter 89 are shown as switched in common by a direction-control signal 66; as will be understood, however, the inversion may be effected before the delay as preferred, and if desired the inversion might be included within the series of components selected by the multiplexer.

Because the pen-carriage speed is servocontrolled and pen-to-medium distance established within conventional mechanical tolerances, the needed delay will be reasonably consistent from one pen to the next. Therefore, in production practice of the invention, adjustability will not ordinarily be needed.

Figure 6:
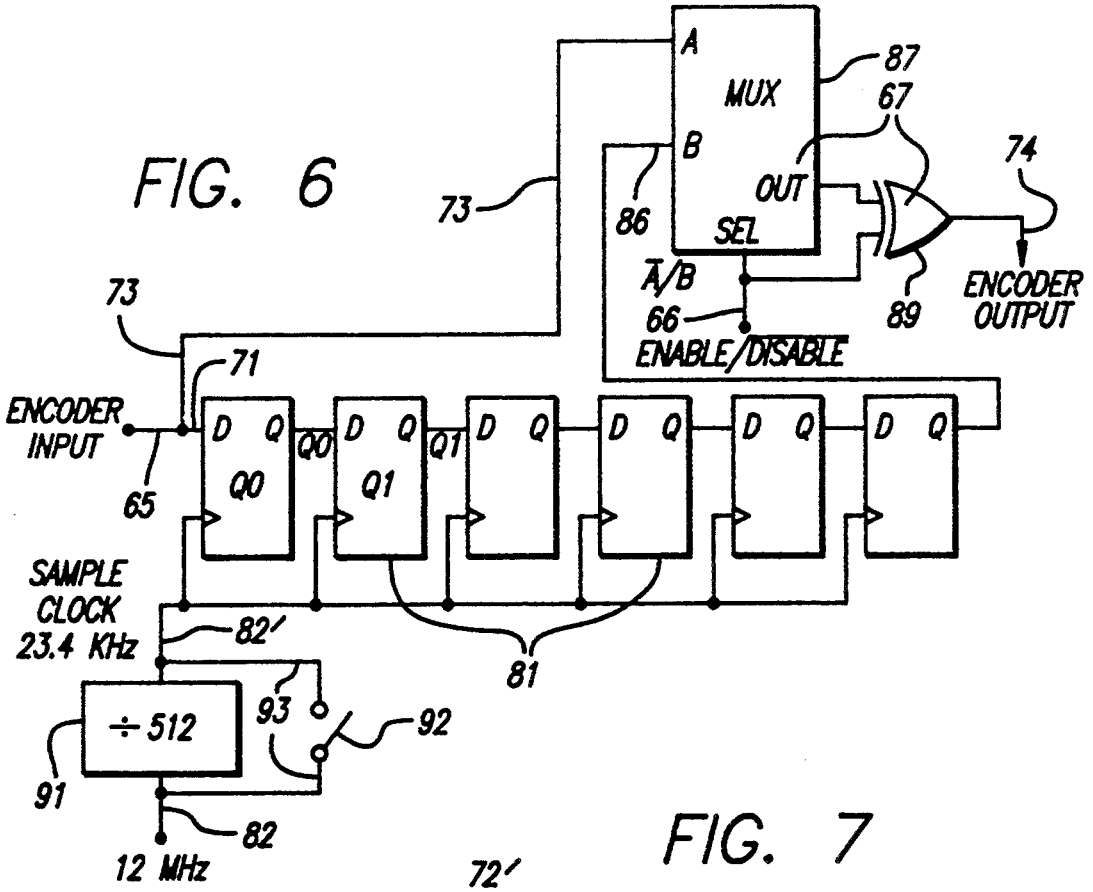
FIG. 6 is a more-detailed schematic for the same module (but not adjustable), including the elements used to select timing uncertainty for improved image quality.

In that case the subsystem 81, 83-85 can be simplified to a shift register that has only the desired number of flipflop stages, or in any event not many stages more than the desired number. The output line 86 can then be hardwired to the last stage, as illustrated in FIG. 6, or to the last stage of the desired set as appropriate.

5. INCREMENTED INTERPOLATION SYSTEMS

In some printing machines, pen-discharge or firing positions are established not by direct, relatively mechanistic, reference to encoder pulses (or positions) and delay lines as such, but rather by reference to a finer set of graduations—or virtual, electronic graduations—derived from the encoder pulses by interpolation. For example, one such machine manufactured by the Hewlett Packard Company is capable of discrete subpixel spacings of a twenty-fourth of a millimeter (a six-hundredth of an inch).

Figure 7:
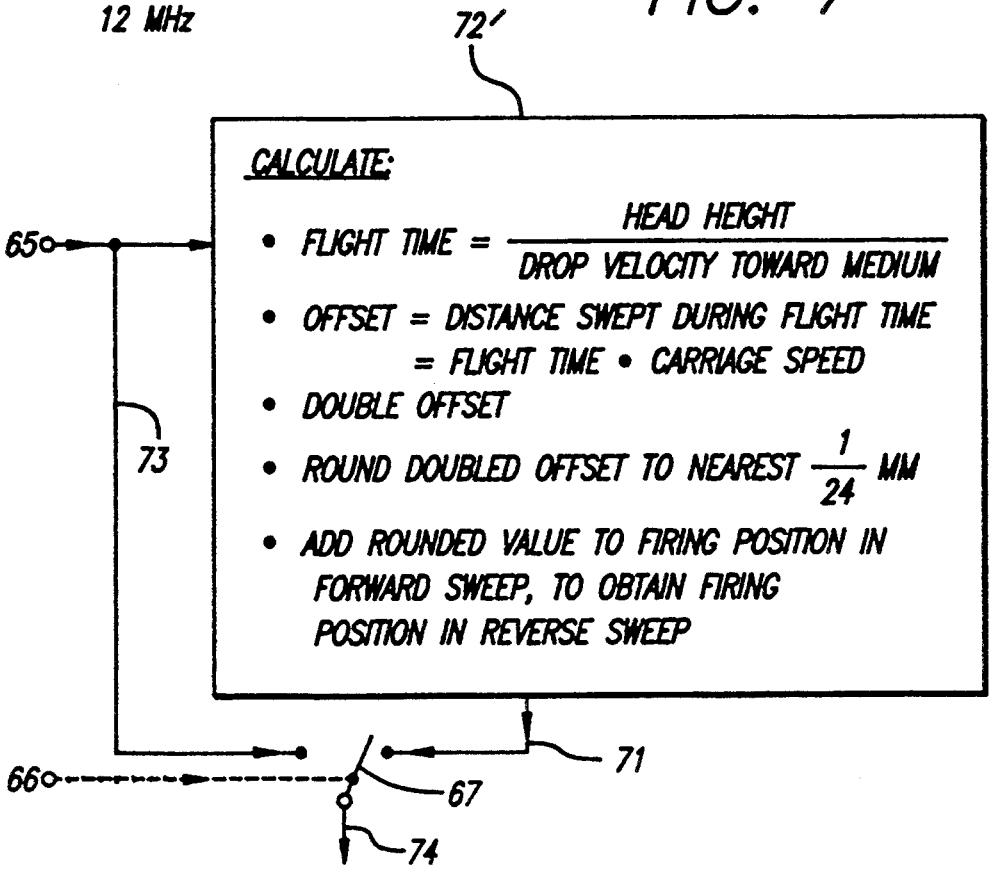
FIG. 7 is an intermediate-level block diagram or schematic showing the equivalent of FIGS. 5 and 6—but for an interpolation system rather than a direct-encoder-reference system.
Figure 8:
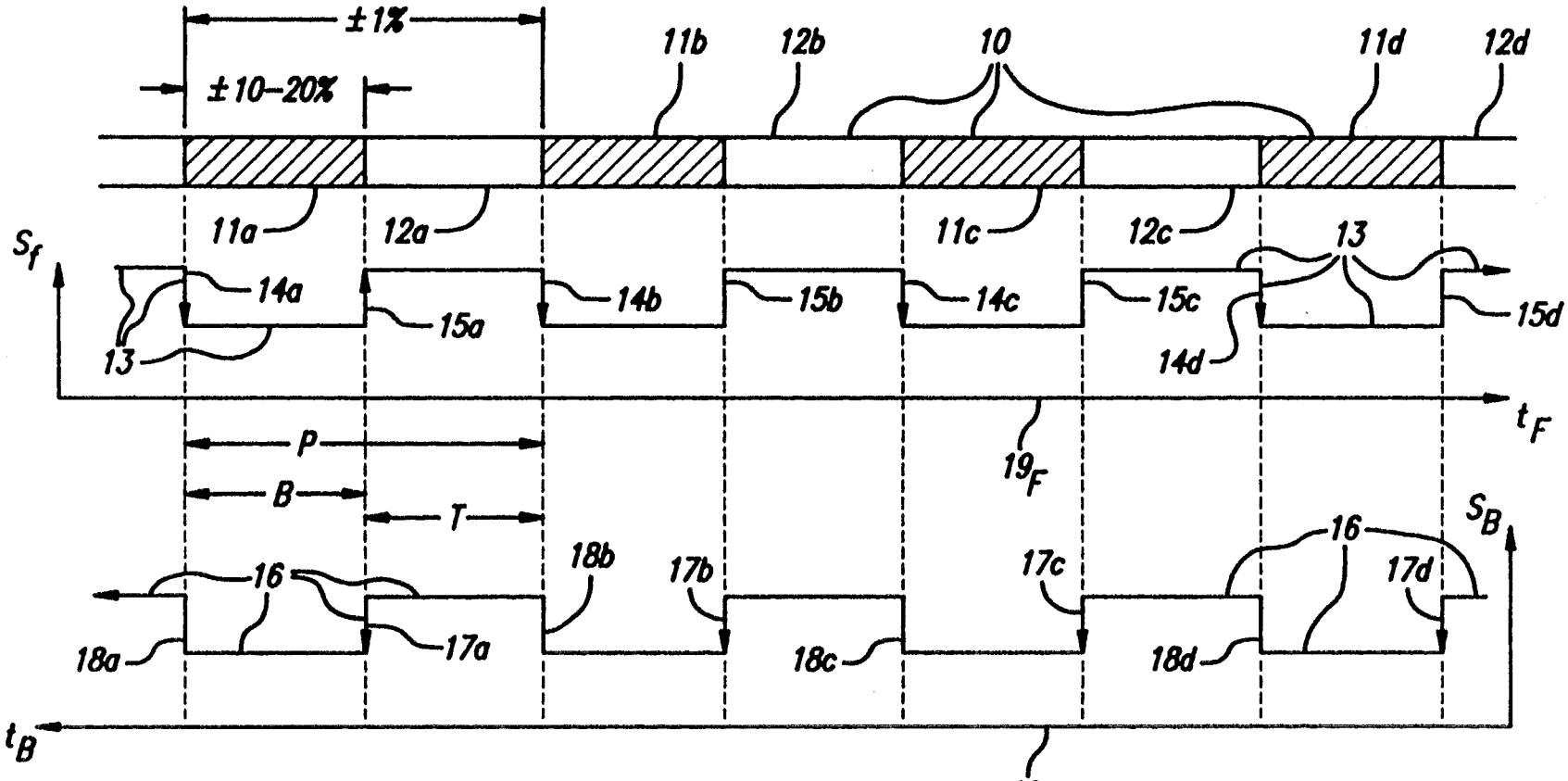
FIG. 8 PRIOR ART
FIG. 8 is a timing diagram analogous to FIG. 1, but showing timing relationships that would obtain if a prior-art encoder-reading circuit were employed without the asymmetrical inversion provided by the present invention.
Figure 9:
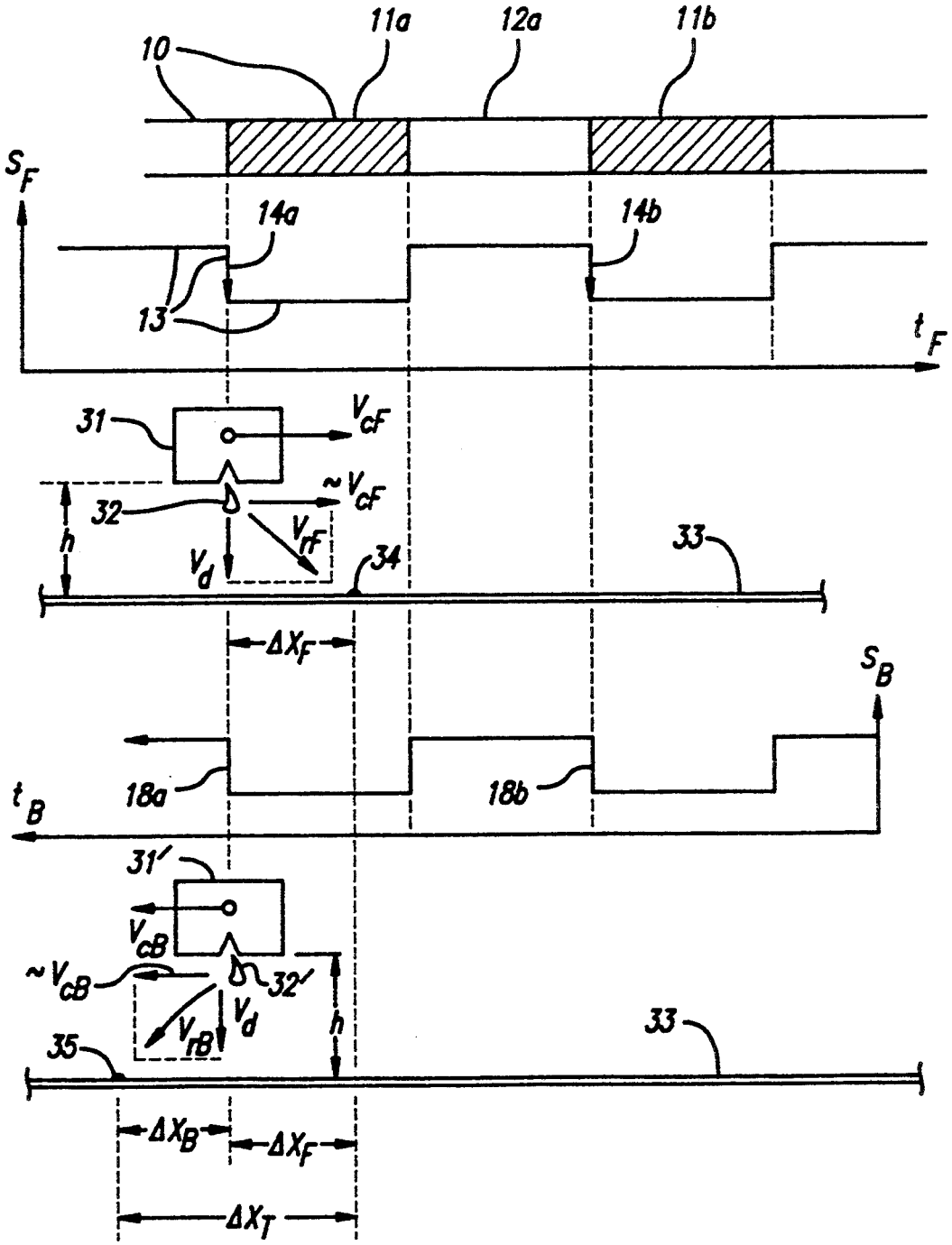
FIG. 9 PRIOR ART
FIG. 9 similarly represents the time-of-flight effects that would be present if a prior-art encoder-reading circuit were employed without the time-of-flight-compensating delay.

FIG. 7 illustrates such operation. The contents of the asymmetric timing module 72' as illustrated here are algorithmic in character.

This notation is meant to imply that, by virtue of the existence of the interpolation system as part of a microprocessor-controlled position-addressing system, the overall processes of pulse inversion and delay here have been reduced to substantially algorithmic calculation-and-addressing processes in the microprocessor (not shown). In such a system the operation of the switch 67 as well is absorbed into the processes of the microprocessor.

In discussion of such printing machines it may not be rigorously accurate to speak of counting to a lower number of encoder pulses per se. Rather it may be more appropriate simply to indicate that the desired ink-spot marking point is bracketed between trigger points that are established in two directions from the desired marking point—and thus approached from those two different directions.

Conceptually such systems may be regarded as counting to a lower output pulse count, or pulse-count value, of the interpolator stage rather than that of the encoder sensor. As a matter of actual algorithmic steps, however, in any particular system the desired count or position for pen firing may be developed in such a way that it is difficult to pinpoint a particular step in which such counting can be clearly said to occur—it may be, so to speak, "buried" in the firmware.

Nevertheless, through operation of the commutative law of addition and subtraction, such a system will be understood to be an equivalent of a system which, as described above, counts to a lower pulse-count value. That is just another way to say that the needed difference in counting must be implemented at some point, or within some sequence of steps, in the overall system operation—but use of any of a very great number of different points, or different sequences, may be operationally equivalent and within the scope of the invention.

In one particular printing machine that operates according to the present invention, it is preferred to use the FIG. 7 system only for printing black, and only at two specific sweep speeds. People skilled in the art, however, will understand that the invention is not necessarily limited to such applications.

In that same machine, which is currently considered the most highly preferred embodiment of the invention, the nominal height of the marking head (pen) above the printing medium is 1.6 millimeters, the component of ink-drop velocity normal to the medium is 11½ meters per second, and the carriage speed is roughly 68 centimeters per second in normal-performance mode, or 51 in high-quality mode. From these values it can be calculated that the flight time is about 0.14 millisecond, and the flight-time offset along the direction of marking-head scanning is roughly 0.1 millimeter in normal-performance mode or 0.07 millimeter in high-quality mode.

In the machine under discussion, as mentioned earlier, the pixel spacing is approximately one twenty-fourth of a millimeter. Expressed in pixel-spacing units, therefore, the $0.1\times24=2.4$ units in normal-performance mode and $0.07\times24=1.7$ units in high-quality mode, or roughly two units in both modes.

During the reverse sweep, to obtain desired alignment, this distance is added to the desired ink-spot position on the printing medium—or double the distance is added to the firing position used in the forward scanning direction. As will be understood, when the distance is thus "added" during the reverse sweep the consequent firing position is an earlier one along the reverse path.

6. TIMING UNCERTAINTY TO IMPROVE PRINTING QUALITY

In bidirectional double-dot-always rapid printing of transparencies, it was noticed that at 10.6 μsec timing uncertainty (corresponding to about 1/32 pixel-column width) the transparencies started to show increased mottling in the solid fill areas, especially for cyan. This problem was introduced earlier in the "PRIOR ART" section of this document.

When the uncertainty was increased to 42.6 μsec (corresponding to about ⅛ column width) it was noted that mottling was visibly reduced. The objectionable mottling was diminished to nearly its level in a standard transparency produced by a printer of the PaintJet® type manufactured by the Hewlett Packard Company.

In this system, however—as contrasted with the PaintJet® printer—by virtue of the present invention this improved performance can be obtained with very significantly increased throughput. Whereas the PaintJet® device can produce a complete transparency in some eight minutes, a printer employing the present invention can produce very nearly equal print quality in only about 4½ minutes.

The previously discussed delay line 81-85 for the bidirectional printing method samples the encoder 10 output signal 65 at uniform intervals determined by the period of the delay-line shift-register clock 82 (FIG. 5). Since the encoder edge transitions 14 (FIGS. 1 and 2) can occur at any time between two consecutive shift-register clock 82 transitions, the basic uncertainty of the actual time delay from the encoder transition 14 to the output 86 of the delay line is equal to the period of the sample clock.

Figure 3:
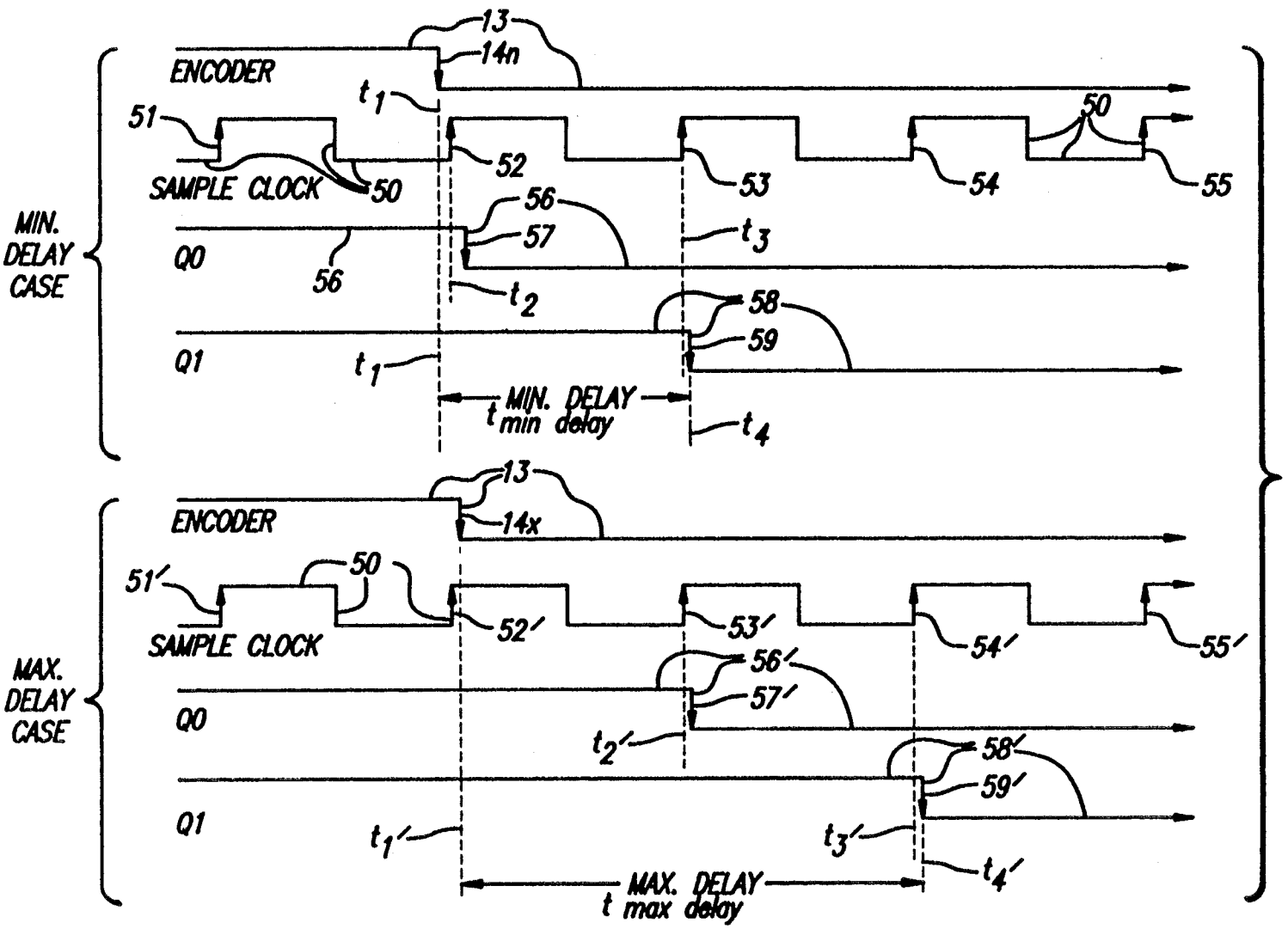
FIG. 3 presents diagrams of the timing-uncertainty relationships which the present invention exploits to improve image quality—in particular illustrating the minimum (upper portion) and maximum available delay.

FIG. 3 shows why this last statement statement is true. When a falling edge **14*n* of the encoder pulsetrain 13 occurs at a first time $t_1$ immediately before the time $t_2$ of a rising edge 52 of the sample-clock train 50, the first flipflop stage Q0 of the shift register 81 (FIGS. 5 and 6) responds a very short time thereafter by dropping 57 its output signal 56**.

This response sets up the system for progressive operation of the downstream stages on successive rising edges 53, 54 . . . of the sample clock 50; in particular, at a third time $t_3$ the immediately subsequent rising edge 53 occurs, inducing the second flipflop stage Q1 to respond, at a time $t_4$ very shortly after, by dropping 59 its output signal 58. FIG. 3 shows that this event is delayed relative to the encoder pulse **14*n* by an interval $t_4-t_{t1}$ that is just very slightly greater than one full clock period—that is, the time between two successive (or, as seen graphically, adjacent) rising edges 52, 53 of the clock train 50**.

This interval is identified, in the upper portion of FIG. 3, as a minimum possible delay $t_{min\ delay}=t_4-t_1$. As now can be appreciated, this occurs when the encoder waveform 13 happens to have a falling edge **14*n* in a minimum-delay timing relationship with the sample-clock train 50**.

By contrast if the encoder waveform 13 happens to have a falling edge **14*x* in a maximum-delay timing relationship with the clock train 50, triggering of the second stage Q1 will take nearly an entire clock period longer. This is shown in the lower portion of FIG. 3**.

In this case the encoder-pulse falling edge **14*x* occurs at a first time $t_1'$ that is immediately after a rising edge 52' of the sample clock 50—or, in other words, the encoder-train falling edge 14*x* just misses an opportunity to trigger the first stage Q0 of the shift register. The first stage Q0 therefore will not be reset 57' until the next clock pulse 53'** occurs—at a second time $t_2'$ that is nearly a whole clock period later.

Once that has happened, triggering 58' of the second-stage flipflop Q1 transpire at a third time $t_3'$, which is the time of the next-following clock pulse 54'. The second stage responds by resetting 58' at a fourth time $t_4$ that is a small fraction of a clock period later; FIG. 3 identifies the corresponding delay of the second-stage reset 58', relative to the encoder falling edge **14*x***, as a maximum possible value $t_{max\ delay}=t_4'-t_1'$.

The uncertainty interval is equal to the difference between maximum and minimum delays, and this in turn very equals the period—or the reciprocal of the frequency—of the sample clock:

$$t_{uncertainty}\equiv t_{max\ delay}-t_{min\ delay}\equiv 1/f_s,$$

where $f_s$ is the frequency of the sample clock. Since the sample clock is truly asynchronous with respect to the encoder signal, a uniform distribution of delay values will result, bounded by the minimum and maximum values.

By controlling the period of the sample clock, the amount of uncertainty, or what might be called "noise", introduced into the unidirectional print system can be precisely controlled. The sample-clock period is advantageously lengthened by switching in a divide-by-512 (or "÷512") counter; thus in the apparatus of our invention the undivided sample clock (used for all other modes of the printer) has a frequency of 12 MHz, and the output of the ÷512 counter is 12 MHz÷512=23.4 kHz.

The sample-clock period corresponding to this frequency is 1/(23.4 kHz)=42.7 μsec. Since the pen nominally scans through a full pixel column in 333.3 μsec, the uncertainty corresponding to the sample-clock frequency and period is $$(42.7\ \mu sec)/(333.3\ \mu sec)=0.128\ \text{column}\tfrac{1}{32}\ \text{column}.$$

These values of delay and associated uncertainty are chosen for average pen behavior, and as will be understood will differ for other systems.

FIG. 6 symbolizes switching the ÷512 counter 91 into the circuit by an open position of a switch 92—for use only when appropriate, as for double-drop-always bidirectional printing of transparencies. Closing the switch symbolizes taking the ÷512 counter out of the circuit, by means of a shunt or bypass 93, for other printing modes.

An equivalent way of representing this function would be to illustrate an adjustable or selectable "÷n" counter—which might for example encompass adjustment to the value n=1. Such a counter, a "÷1" counter, would be capable of division by unity and so would produce the same result as the bypass 93 illustrated.

This noisy-delay approach is currently considered to be specific to double-drop-always printing of transparencies, but may well be applicable in other applications to mitigate moderately excessive inking.

We have found that the provisions which have been described can provide precise alignment of images formed in adjacent swaths (groups of pixels created in individual pen scans across the printing medium) during bidirectional printing. These-provisions are sufficient to allow a throughput increase of sixty percent without the type of image degradation that arises from positional imprecision.

Since all of the facets or aspects of the invention operate by processing the encoder signal only, the invention can be adapted to virtually any inkjet printer by inserting the switchable inverter/decrementer/delay-line module in series with the machine's encoder electronics, and making modest changes in the machine's firmware.

These improvements are enjoyed despite relatively large variations in encoder-bar width. They also are accompanied—for the special case of double-drop-always bidirectional transparency printing—by significant reductions in mottling, achieved through deliberate reintroduction of a small, random positional imprecision.

It will be understood that the foregoing disclosure is intended to be merely exemplary, and not to limit the scope of the invention—which is to be determined by reference to the appended claims.

What is claimed is:

1. A method of printing images on a printing medium by construction from individual marks formed in pixel arrays by a bidirectionally scanning print head that operates along a scan axis, while position of the print head is determined by reference to graduations of a scale, each graduation having first and second physical features; said method comprising the steps of:

scanning the head in a first direction along a scan axis;

while scanning the head in the first direction, operating a position-determining system that senses graduations of the scale, and that encounters the first and second physical features of each graduation in a first particular order;

while scanning the head in the first direction, controlling the head by reference to the first physical features exclusively, to form marks on the printing medium;

then scanning the head in a second direction along the same scan axis;

while scanning the head in the second direction, operating the same position-determining system that senses the same graduations, and that encounters the same first and second physical features of each graduation, but in a second particular order that is the reverse of the first order;

while scanning the head in the second direction, controlling the head by reference to the first physical features exclusively, to form marks on the printing medium;

whereby the marks are formed on the printing medium by reference to the same physical positions independent of scanning direction, notwithstanding the reverse order in which the first and second physical features of each graduation are encountered; and wherein:

during said scanning of the head in the first direction, said position-determining-system-operating step comprises providing a first original position-indicating electrical waveform that has first and second electrical features of opposite sense, derived respectively from sensing of the first and second physical features of the scale;

during scanning of the head in the first direction, the head-controlling step comprises controlling the head by reference to the first electrical feature of said first original waveform;

during said scanning of the head in the second direction, said position-determining-system-operating step comprises providing a second original position-indicating electrical waveform that has said same first and second electrical features of opposite sense, derived respectively from sensing of the first and second physical features of the scale, but all reversed in sense relative to their occurrences in the first original waveform;

and further comprising the step of, while scanning the head in the second direction and operating the position-determining system, deriving from said position-indicating electrical waveform a new version of the second original waveform that has said first and second electrical features of opposite sense, but each being reversed in sense relative to those in the second original waveform;

whereby the second electrical feature of the new version has the same sense as said first electrical feature of the first original waveform.

2. The method of claim 1, wherein:

said deriving step comprises inverting said second original waveform to generate an inverted waveform that is said new version.

3. The method of claim 1, wherein:

the print head comprises an inkjet pen; and the controlling step comprises operating the inkjet pen to propel ink drops toward the printing medium to form the marks on the medium; and said method further comprising the steps of:

while scanning in the first direction, controlling the pen from a certain one of said first electrical features of the first original waveform, to make a first mark at a particular location; and while scanning in the second direction, controlling the pen from a particular one of said second electrical features of the new waveform version to make a second mark at the same particular location;

said particular one of said new-version electrical features being encountered at least one period in advance of one of said new-version electrical features that corresponds in position to said first electrical feature of the first original waveform.

4. The method of claim 3, wherein:

said pen-controlling step while scanning in the second direction comprises delaying discharge of ink from the pen, after sensing of said particular one of said new-version electrical features, so that said second mark is substantially aligned with said first mark.

5. The method of claim 3, further comprising the step of:

when printing with two or more ink drops at each pixel location on transparency stock, selecting a relatively high value of uncertainty in print position.

6. The method of claim 5, wherein:

said relatively high value corresponds to significantly more than one sixteenth of one pixel column width.

7. Apparatus for printing images on a printing medium by construction from individual marks formed in pixel arrays; said apparatus comprising:

means for supporting such printing medium;

a print head mounted for motion across the medium;

means for scanning the head bidirectionally across the medium;

an encoder strip extended across the supporting means parallel to the print-head motion across the medium, and having first and Second physical features substantially in alternation;

electrooptical means for reading the encoder strip to generate a square wave whose pulses correspond to combinations of said first and second physical features and thereby to positions across the medium; and means, connected to receive the square wave from the electrooptical means, for responding to said first physical features exclusively, irrespective of scanning direction, to control the head to form marks on the medium; and wherein the responding means comprise:

means for responding to falling edges of a received wavetrain to control the head to form marks on the medium; and direction-sensitive means, connected between the electrooptical means and the responding means, for inverting the square wave before receipt by the responding means during scanning in only one of two directions of scanning of the head across the medium.

8. The apparatus of claim 7, wherein:

the direction-sensitive means further comprise means for interposing a delay between the electrooptical means and the responding means, during scanning in said same only one direction;

whereby control of the head to form marks on the medium is delayed after occurrences of the falling edges of the inverted square wave.

9. The apparatus of claim 8, wherein:

the delay-interposing means comprise a delay line that is switched into the connection between the electrooptical means and the responding means, only during scanning in said same only one direction.

10. The apparatus of claim 9, wherein:

the delay line comprises a shift register that is advanced by a signal from a sample clock.

11. The apparatus of claim 10, further comprising:

means for adjusting the sample-clock period to a relatively high value when bidirectionally printing two or more drops per pixel on a transparent printing medium.

12. The apparatus of claim 11, wherein:

said relatively high value exceeds the time interval during which the print head scans through one-sixteenth of a pixel column.

13. The apparatus of claim 12, wherein: p1 said relatively high value is approximately the time interval during which the print head scans through one eighth of a pixel column.

14. The apparatus of claim 11, wherein:

said relatively high value exceeds forty microseconds.

15. A method of printing images on a printing medium by construction from individual ink drops formed in pixel arrays by a bidirectionally scanning inkjet pen; said method comprising the steps of:

scanning the pen in a first direction;

while scanning the pen in the first direction, operating a position-sensitive system to provide a first original position-indicating electrical waveform that has first and second periodically repeating features of opposite sense;

while scanning the pen in the first direction, controlling the pen by reference to the first periodically repeating feature of said first original waveform, to propel ink drops toward the printing medium;

then scanning the pen in a second direction;

while scanning the pen in the second direction, operating the same position-sensitive system to provide a second original position-indicating electrical waveform that has said first and second periodically repeating features of opposite sense;

while scanning the pen in the second direction and operating the position-sensitive system, inverting said second position-indicating electrical waveform to form an inverted waveform that has said first and second periodically repeating features of opposite sense, but each being reversed in sense relative to those in the second original waveform;

whereby the second periodically repeating feature of the inverted waveform has the same sense as said first feature of the first original waveform;

while scanning the pen in the second direction, controlling the pen by reference to said second periodically repeating feature of the new version, to propel ink drops toward the printing medium.

16. Apparatus for printing images on a printing medium by construction from individual marks formed in pixel arrays; said apparatus comprising:

means for supporting such printing medium;

a print head mounted for motion across the medium;

means for scanning the head bidirectionally across the medium;

an encoder strip extended across the supporting means parallel to the print-head motion across the medium, and having first and second physical features substantially in alternation;

electrooptical means for reading the encoder strip to generate a square wave whose pulses correspond to combinations of said first and second physical features and thereby to positions across the medium; and means, connected to receive the square wave from the electrooptical means, for responding to said first physical features exclusively irrespective of scanning direction, to control the head to form marks on the medium; and wherein:

the encoder strip has dimensional tolerance on the order of plus-or-minus one percent from each of said first physical features to the next of said first physical features;

the encoder strip has dimensional tolerance on the order of plus-or-minus ten to twenty percent from each of said first physical features to an adjacent one of said second physical features; and through operation of the responding means, the positioning precision of the responding means is on the order of plus-or-minus one percent.

* * * * *